United States Patent [19]

McWhirter

[11] Patent Number: 4,961,407

[45] Date of Patent: Oct. 9, 1990

[54] ROCKER ARM WITH A COST PUSH ROD SEAT

[75] Inventor: John A. McWhirter, Olive Branch, Miss.

[73] Assignee: Competition Cams, Inc., Memphis, Tenn.

[21] Appl. No.: 342,543

[22] Filed: Apr. 24, 1989

[51] Int. Cl.[5] ..... F01L 1/18

[52] U.S. Cl. ..... 123/90.41; 123/90.47

[58] Field of Search ..... 123/90.39, 90.41, 90.47, 123/90.63

[56] References Cited

U.S. PATENT DOCUMENTS

| | | | |
|---|---|---|---|
| 3,150,648 | 9/1964 | Gropp | 123/90.39 |
| 3,289,657 | 12/1966 | Winter, Jr. | 123/90.41 |
| 3,667,434 | 6/1972 | Sandusky | 123/90.41 |
| 3,754,539 | 8/1973 | Bandimere | 123/90.41 |
| 4,314,732 | 2/1982 | Murphy | 123/90.41 |
| 4,333,426 | 6/1982 | Gavasso et al. | 123/90.37 |
| 4,440,121 | 4/1984 | Clancy et al. | 123/90.41 |
| 4,643,144 | 2/1987 | Fingerle et al. | 123/90.39 |
| 4,784,095 | 11/1988 | Golding et al. | 123/90.41 |
| 4,796,576 | 1/1989 | Matsuura et al. | 123/90.44 |
| 4,825,717 | 5/1989 | Mills | 123/90.39 |

*Primary Examiner*—David A. Okonsky
*Assistant Examiner*—Weilun Lo
*Attorney, Agent, or Firm*—Walker & McKenzie

[57] ABSTRACT

A rocker arm for a rocker arm assembly of an internal combustion engine. The rocker arm includes a pushrod portion for engaging the distal end of the pushrod and for movement between a raised position and a lowered position, the pushrod portion having a pushrod seat cast thereinto for receiving the distal end of the pushrod; a valve stem portion for engaging the distal end of the valve stem for movement between a raised position and a lowered position; and an intermediate portion fixedly connecting the pushrod portion and the valve stem portion to one another, the rocker arm attachment the pivotally attaching the intermediate portion of the rocker arm to the rocker arm support structure to allow the pushrod portion and the valve stem portion to pivot between the raised and lowered positions.

7 Claims, 3 Drawing Sheets

ROCKER ARM WITH A COST PUSH ROD SEAT

BACKGROUND OF THE INVENTION

1. Field of the Invention

The present invention relates, in general, to a rocker arm for an internal combustion engine.

2. Information Disclosure Statement:

Various specific rocker arms have heretofore been developed. A typical prior art rocker arm includes a body having a pushrod portion for engaging the distal end of a pushrod of the engine and having an oil passageway bore drilled or otherwise machined therethrough for allowing oil from the pushrod to squirt past the rocker arm and includes a pushrod seat pressed into the pushrod portion of the body for receiving the distal end of the pushrod. Certain prior art rocker arms include tab portions or the like above the upper end of the oil passageway bore to deflect at least a portion of the oil being squirted through the oil passageway back toward the rocker arm and adjacent bearings and the like. None of the known prior art rocker arms disclose or suggest the present invention.

SUMMARY OF THE INVENTION

The present invention is directed toward providing an improved rocker arm for internal combustion engines. The rocker arm of the present invention includes a pushrod portion for engaging the distal end of a pushrod of an internal combustion engine and for movement between a raised position and a lowered position, the pushrod portion having a pushrod seat for receiving the distal end of the pushrod and having an orifice for communicating with the pushrod seat and for allowing oil from the longitudinal bore of the pushrod to pass therethrough; the pushrod portion having an oil directional channel for communicating with one side of the orifice for causing a portion of the oil passing through the orifice to flow toward the bearing member while the remainder of the oil passing through the orifice will squirt generally upward above the rocker arm, the oil directional passage including a groove on the upper side of the pushrod portion extending from the orifice toward the intermediate portion to allow oil to flow from the orifice toward the rocker arm attachement means; a valve stem portion for engaging the distal end of the valve stem for movement between a raised position and a lowered position; and an intermediate portion fixedly connecting the pushrod portion and the valve stem portion to one another, the rocker arm attachement means pivotally attaching the intermediate portion of the rocker arm to the rocker arm support structure to allow the pushrod portion and the valve stem portion to pivot between the raised and lowered positions.

DESCRIPTION OF THE PREFERRED EMBODIMENT

Figure 1:
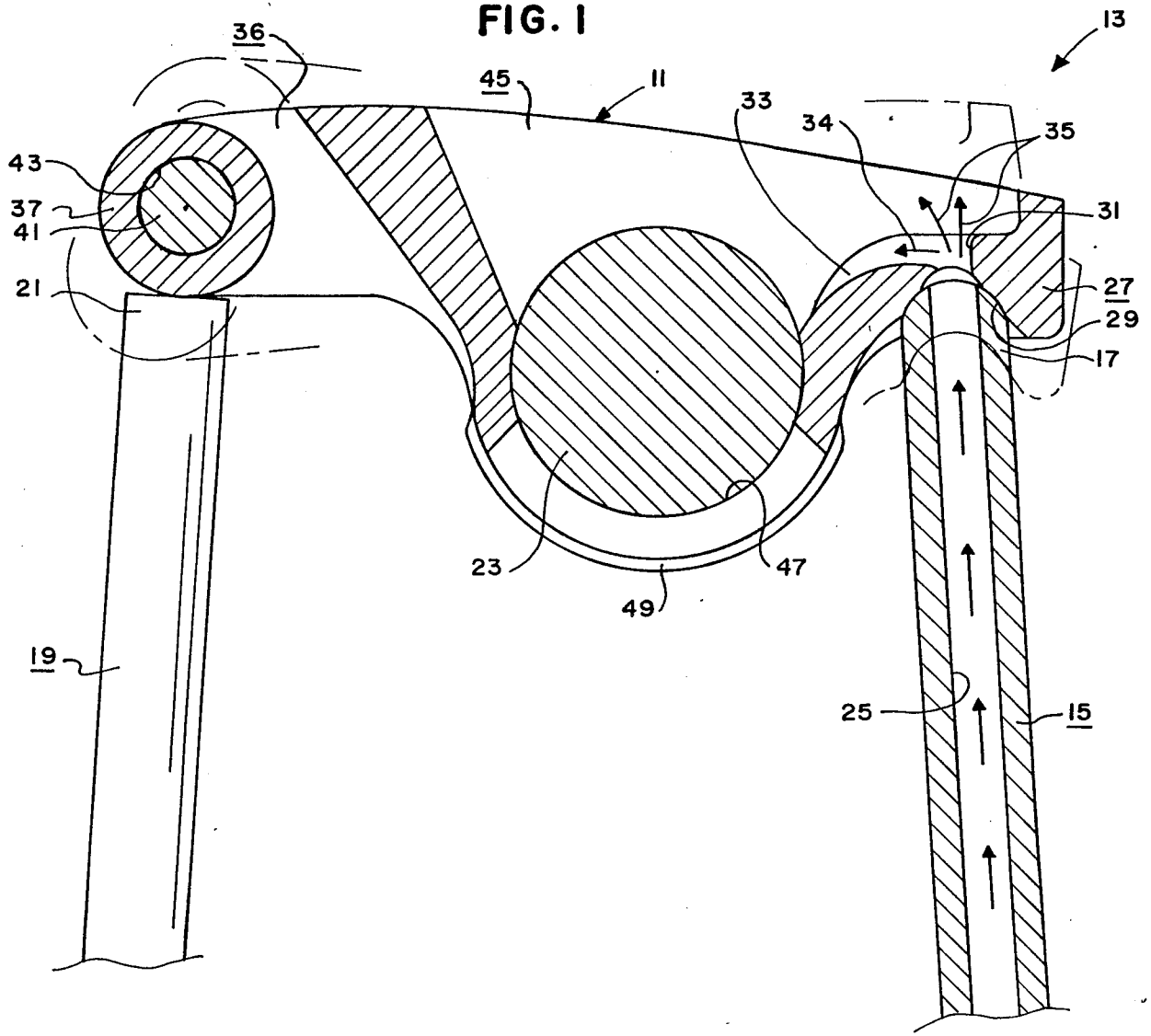
FIG. 1 is a somewhat diagrammatic sectional view of the rocker arm of the present invention shown in combination with portions of an internal combustion engine.
Figure 2:
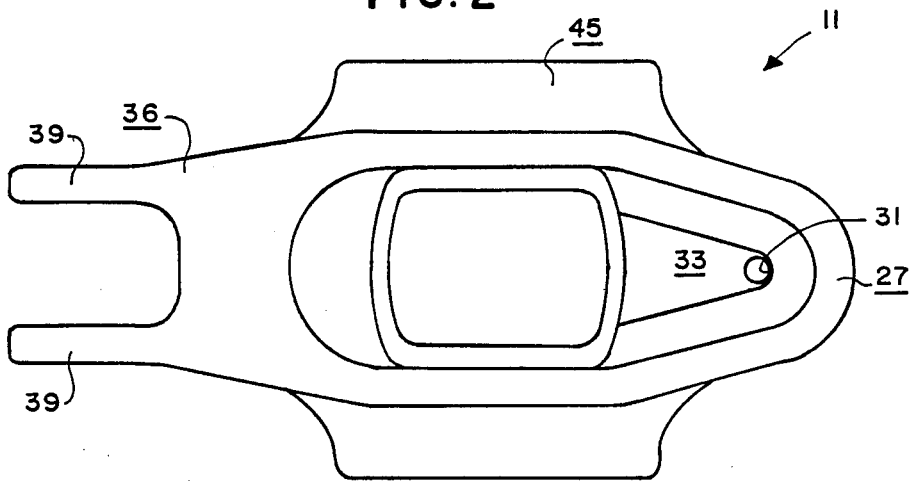
FIG. 2 is a top plan view of the rocker arm of FIG. 1.

The rocker arm 11 of the present invention is part of a rocker arm assembly 13 of an internal combustion engine. The engine includes a rocker arm support structure (not shown) such as the cylinder head of the engine, etc., a pushrod 15 having a distal end 17 movable between raised and lowered positions, and a valve stem 19 having a distal end 21 movable between raised and lowered positions. The rocker arm assembly 13 includes a rocker arm attachment means such as a bearing member 23 (see FIG. 1) or a typical bolt/rocker arm ball unit 24 (see FIG. 6) for pivotally attaching the rocker arm 11 to the rocker arm support structure. The pushrod 15 typically has a longitudinal bore 25 through which oil is pumped to the rocker arm 11 in a manner and for reasons as will now be apparent to those skilled in the art. It will be understood by those skilled in the art that FIG. 1 is diagrammatic and various features of the rocker arm assembly 13 and associated structure such as the valve return spring and the like are omitted for clarity.

The rocker arm 11 includes a pushrod portion 27 for engaging the distal end 17 of the pushrod 15 and for movement between a raised position and a lowered position as shown in broken lines in FIG. 1. The pushrod portion 27 has a pushrod seat 29 for receiving the distal end 17 of the pushrod 15 and having an orifice 31 for communicating with the pushrod seat 29 and for allowing oil from the longitudinal bore 25 of the pushrod 15 to pass therethrough. One unique feature of the rocker arm 11 is that the pushrod seat 29 may be cast into the rocker arm 11 as an integral part thereof rather that being machined into the rocker arm 11 or consisting of a separate unit that is press-fitted into a cavity in a rocker arm. The cast-in pushrod seat 29 has several advantages over the prior art machined and/or pressed-in pushrod seats. For example, when used with racing engines that operate at extremely high revolutions-per-minute, the cast-in pushrod seat 29 insures that the pushrod seat 29 does not separate or move relative to the body of the rocker arm 11 which could damage or destroy the engine. Further, the cast-in pushrod seat 29 has the potential of reducing manufacturing time and costs for the rocker arm 11. The distal end 17 of the pushrod 15 is preferably rounded and the pushrod seat 29 is preferably sized and shaped to conform to a portion of the rounded distal end 17 as will now be apparent to those skilled in the art. More specifically, the distal end 17 of the pushrod 15 is preferably substantially hemispherical and the pushrod seat 29 has a generally hemispherical depression therein.

Figure 6:
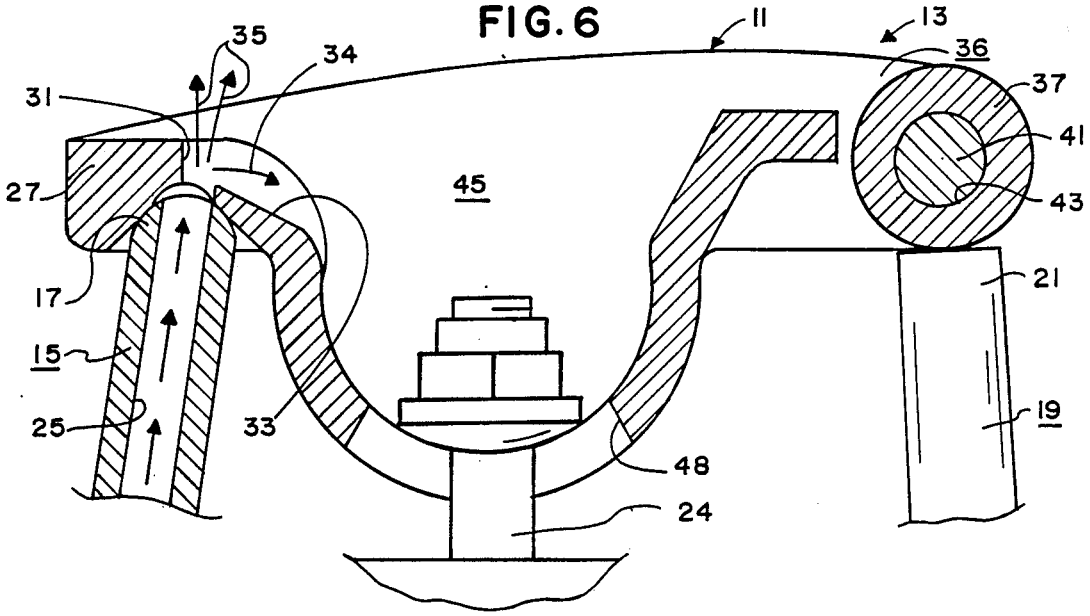
FIG. 6 is a somewhat diagrammatic sectional view of a modified version of the rocker arm of the present invention shown in combination with portions of an internal combustion engine.
Figure 7:
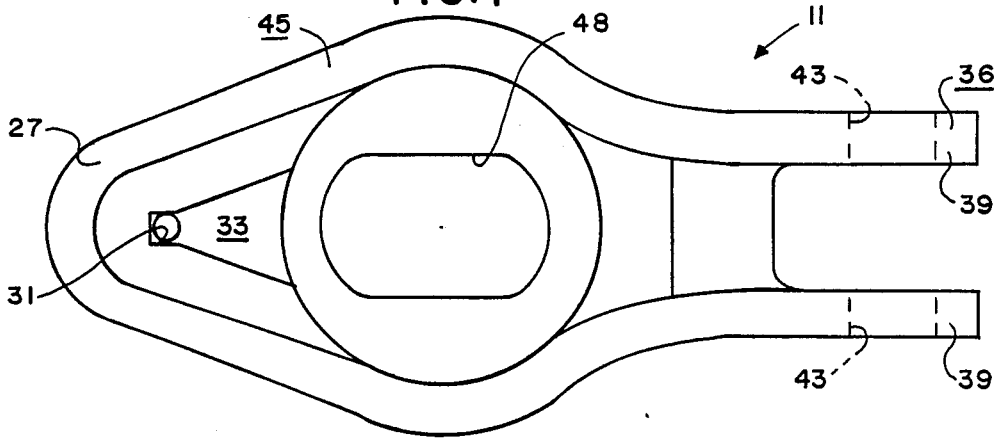
FIG. 7 is a top plan view of the rocker arm of FIG. 6.
Figure 8:
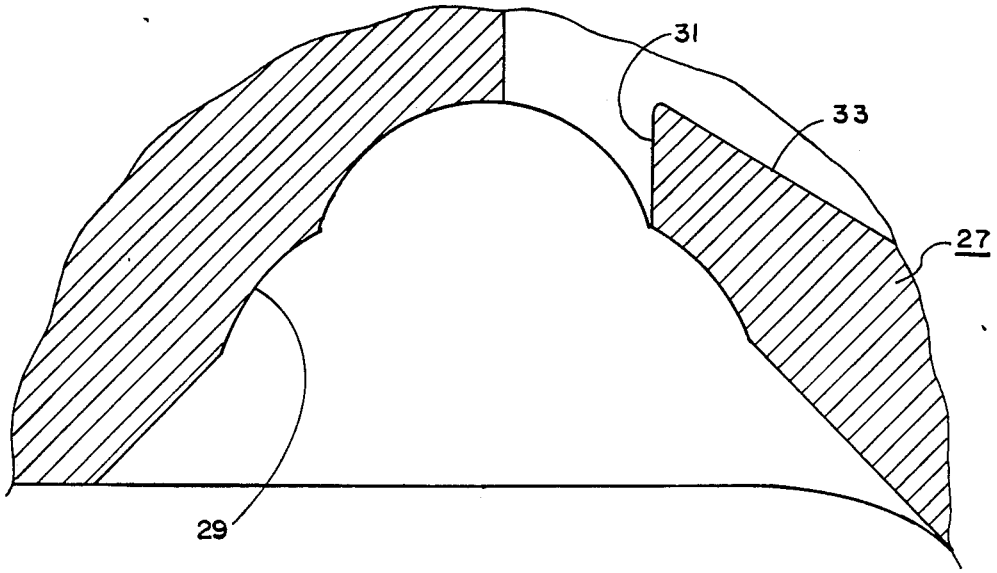
FIG. 8 is an enlarged section view of a portion of the rocker arm of FIG. 6.

Another unique feature of the rocker arm 11 is that the pushrod portion 27 has an oil directional passage 33 for communicating with at least one side of the orifice 31 for causing a portion of the oil passing through the orifice to flow toward the rocker arm attachment means (e.g., the bearing member 23 or the bolt member 24) in the direction of the arrow 34 in FIGS. 1 and 6 while the remainder of the oil passing through the orifice 31 will squirt generally upward above the rocker arm 11 in the direction of the arrows 35 in FIGS. 1 and 6. The oil directional passage 33 preferably consists of a channel or groove on the upper side of the pushrod portion 27 extending from the orifice 31 toward the rocker arm attachment means to allow oil to flow from the orifice 31 toward the rocker arm attachment means. Without the oil directional passage 33, all of the oil passing through the orifice 31 would squirt generally straight upward from the orifice 31 and fall back toward the rocker arm attachment means and the like only after striking the valve cover (not shown) of the engine or tabs or the like that may be provided to break the flow of the oil as will now be apparent to those skilled in the art. The oil directional passageway 33 thus provides several advantages not present in prior rocker arms. This is especially true when the rocker arm 11 is used with racing engines that operate at extremely high revolutions-per-minute. Thus, with such racing engines, the oil pressure is normally high and any oil that squirts through the prior art oil passageway bore is forced past the rocker arm at a high pressure and may not adequately lubricate the bearings and the like associated with the rocker arm, etc. This is compounded by the fact the bearings and associated structure are subjected to greater and/or faster wear due to the high speeds involved, etc. The oil directional passageway 33 acts similar to the choke on the end of a shotgun barrel and causes at least a portion of the oil being forced through orifice 31 to open-up and flow toward the rocker arm attachment means and the like.

The rocker arm 11 includes a valve stem portion 36 for engaging the distal end 21 of the valve stem 19 and for movement between a raised position and a lowered position as shown in broken lines in FIG. 1. The valve stem portion 36 preferably is adapted to receive a valve stem contact means, such as a roller 37, for engaging the distal end 21 of the valve stem 19. More specifically, the valve stem portion 36 preferably includes a spaced pair of ear members 39 to which the roller 37 is rotatably mounted by an axle 41 which extends through apertures 43 in the ear members 39 and the roller 37.

Figure 3:
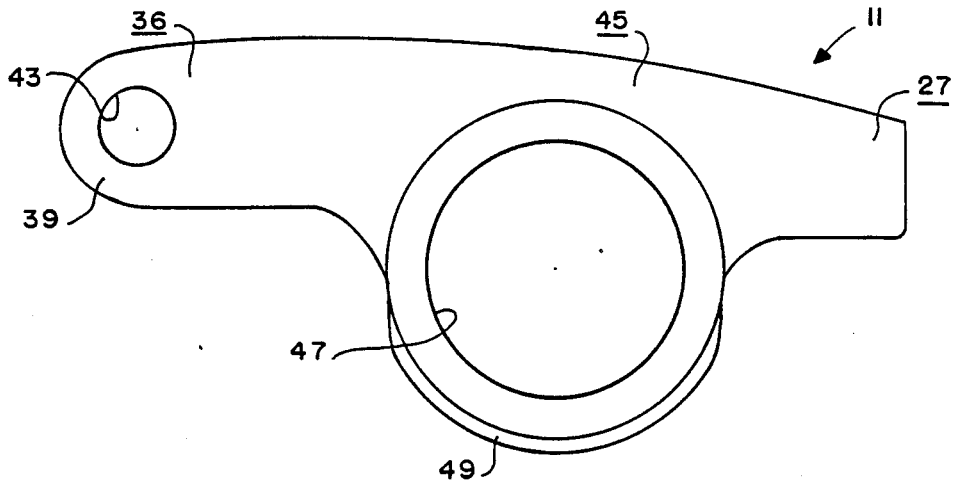
FIG. 3 is a front elevation of the rocker arm of FIG. 1.
Figure 4:
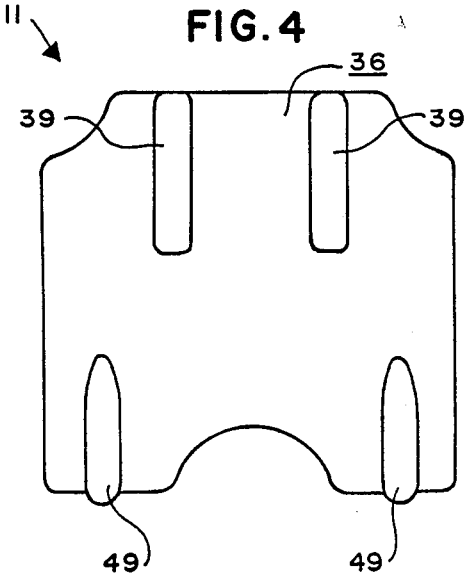
FIG. 4 is a left end elevation of the rocker arm of FIG. 1.
Figure 5:
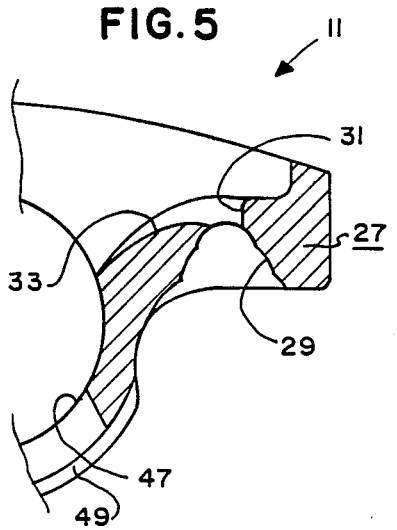
FIG. 5 is a sectional view of a portion of the rocker arm of FIG. 1.

The rocker arm 11 includes an intermediate portion 45 fixedly connecting the pushrod portion 27 and the valve stem portion 36 to one another. The intermediate portion 45 is pivotally attached to the rocker arm support structure by the rocker arm attachment means or the like to allow the pushrod portion 27 and the valve stem portion 36 to pivot between the raised and lowered positions. More specifically, the intermediate portion 45 may have an aperture 47 therethrough for receiving the bearing member 23 as shown in FIGS. 1, 3 and 5 or may be solid as shown in FIG. 6 in which case the bottom of intermediate portion 45 has a slot 48 for receiving a portion of the shank of the bolt of the bolt/rocker arm ball unit 24 as will now be apparent to those skilled in the art.

The rocker arm 11 may be provided with reinforcing ribs 49 to strengthen the rocker arm 11 as will now be apparent to those skilled in the art.

The rocker arm 11 is preferably constructed out of metal as an integral, one-piece unit. More specifically, the rocker arm 11 is preferably precision cast out of metal using the investment or lost wax casting process as will now be apparent to those skilled in the art. By using a precision investment or lost wax casting process, the pushrod seat 29 and orifice 31 can be cast directly into the rocker arm 11 rather than being machined thereinto after an initial casting or stamping operation.

Although the present invention has been described and illustrated with respect to a preferred embodiment and a preferred use therefor, it is not to be so limited since modifications and changes can be made therein which are within the full intended scope of the invention.

I claim:

1. A rocker arm for a rocker arm assembly of an internal combustion engine; said engine including a rocker arm support structure, a pushrod having a distal end movable between a raised position and a lowered position, and a valve stem movable between a raised position and a lowered position; said rocker arm assembly including rocker arm attachment means for pivotally attaching said rocker arm to said rocker arm support structure; said rocker arm comprising:

(a) a pushrod portion for engaging said distal end of said pushrod and for movement between a raised position and a lowered position, said pushrod portion having a pushrod seat cast thereinto for receiving said distal end of said pushrod;

(b) a valve stem portion for engaging said distal end of said valve stem for movement between a raised position and a lowered position; and (c) an intermediate portion fixedly connecting said pushrod portion and said valve stem portion to one another for being pivotally attached to said rocker arm support structure to allow said pushrod portion and said valve stem portion to pivot between said raised and lowered positions.

2. A rocker arm for a rocker arm assembly of an internal combustion engine; said engine including a rocker arm support structure, a pushrod having a distal end movable between a raised position and a lowered position, said pushrod having a longitudinal bore through which oil is pumped to said rocker arm; and a valve stem movable between a raised position and a lowered position; said rocker arm assembly including rocker arm attachment means for pivotally attaching said rocker arm to said rocker arm support structure; said rocker arm comprising:

(a) a pushrod portion for engaging said distal end of said pushrod and for movement between a raised position and a lowered position, said pushrod portion having a pushrod seat cast thereinto for receiving said distal end of said pushrod; said pushrod portion having an orifice for communicating with said pushrod seat and for allowing oil from said longitudinal bore of said pushrod to pass therethrough; said pushrod portion having an oil directional channel for communicating with one side of said orifice for causing a portion of the oil passing through said orifice to flow toward the bearing member while the remainder of the oil passing through the orifice will squirt generally upward above said rocker arm, said oil directional channel including a groove on the upper side of said pushrod portion extending from said orifice toward said intermediate portion to allow oil to flow from said orifice toward said rocker arm attachment means;

(b) a valve stem portion for engaging said distal end of said valve stem for movement between a raised position and a lowered position; and (c) an intermediate portion fixedly connecting said pushrod portion and said valve stem portion to one another for being pivotally attached to said rocker arm support structure to allow said pushrod portion and said valve stem portion to pivot between said raised and lowered positions.

3. A rocker arm for a rocker arm assembly of an internal combustion engine; said engine including a rocker arm support structure, a pushrod having a distal end movable between a raised position and a lowered position, and a valve stem movable between a raised position and a lowered position; said rocker arm assembly including rocker arm attachment means for pivotally attaching said rocker arm to said rocker arm support structure, said pushrod having a longitudinal bore through which oil is pumped to said rocker arm; said rocker arm comprising:

(a) a pushrod portion for engaging said distal end of said pushrod and for movement between a raised position and a lowered position, said pushrod portion having a pushrod seat for receiving said distal end of said pushrod and having an orifice for communicating with said pushrod seat and for allowing oil from said longitudinal bore of said pushrod to pass therethrough; said pushrod portion having an oil directional channel for communicating with one side of said orifice for causing a portion of the oil passing through said orifice to flow toward the bearing member while the remainder of the oil passing through the orifice will squirt generally upward above said rocker arm, said oil directional channel including a groove on the upper side of said pushrod portion extending from said orifice toward said intermediate portion to allow oil to flow from said orifice toward said rocker arm attachment means;

(b) a valve stem portion for engaging said distal end of said valve stem for movement between a raised position and a lowered position; and (c) an intermediate portion fixedly connecting said pushrod portion and said valve stem portion to one another for being pivotally attached to said rocker arm support structure to allow said pushrod portion and said valve stem portion to pivot between said raised and lowered positions.

4. The rocker arm of claim 3 in which said pushrod seat is cast into said pushrod portion.

5. The rocker arm of claim 4 in which said pushrod portion, said valve stem portion and said intermediate portion are cast out of metal as a one-piece, integral unit.

6. In an internal combustion racing engine having a rocker arm support structure, a pushrod having a distal end movable between a raised position and a lowered position, and a valve stem movable between a raised position and a lowered position; a rocker arm assembly comprising:

(a) a rocker arm; said rocker arm including:

(i) a pushrod portion for engaging said distal end of said pushrod and for movement between a raised postion and a lowered position, said pushrod portion having a pushrod seat cast thereinto for receiving said distal end of said pushrod;

(ii) a valve stem portion for engaging said distal end of said valve stem for movement between a raised position and a lowered position; and (iii) an intermediate portion fixedly connecting said pushrod portion and said valve stem portion to one another for being pivotally attached to said rocker arm support structure to allow said pushrod portion and said valve stem portion to pivot between said raised and lowered positions; and (b) rocker arm attachment means for pivotally attaching said rocker arm to said rocker arm support structure.

7. The rocker arm assembly of claim 6 in which said pushrod portion, said valve stem portion and said intermediate portion are cast out of metal as a one-piece, integral unit.

* * * * *

UNITED STATES PATENT AND TRADEMARK OFFICE

CERTIFICATE OF CORRECTION

PATENT NO. : 4,961,407

DATED : October 9, 1990

INVENTOR(S) : John A. McWhirter

It is certified that error appears in the above-identified patent and that said Letters Patent is hereby corrected as shown below:

On the title page, item [54], in the title:
Change "ROCKER ARM WITH A COST PUSH ROD SEAT"

to --ROCKER ARM WITH A CAST PUSH ROD SEAT--.

Column 1, Title; change "ROCKER ARM WITH A COST PUSH ROD SEAT" to --ROCKER ARM WITH A CAST PUSH ROD SEAT--.

ABSTRACT, line 11; delete the second occurrence of "the".

Signed and Sealed this

Ninth Day of June, 1992

*Attest:*

DOUGLAS B. COMER

*Attesting Officer*

*Acting Commissioner of Patents and Trademarks*